US010683687B2

(12) United States Patent
Borgen

(10) Patent No.: US 10,683,687 B2
(45) Date of Patent: Jun. 16, 2020

(54) SILENT DOOR STOP AND CATCH

(71) Applicant: Karl L. Borgen, Germanton, NC (US)

(72) Inventor: Karl L. Borgen, Germanton, NC (US)

( * ) Notice: Subject to any disclaimer, the term of this patent is extended or adjusted under 35 U.S.C. 154(b) by 0 days.

(21) Appl. No.: 16/177,981

(22) Filed: Nov. 1, 2018

(65) Prior Publication Data

US 2020/0141165 A1 May 7, 2020

(51) Int. Cl.

*E05F 5/02* (2006.01)
*E05C 17/46* (2006.01)
*E05F 5/06* (2006.01)

(52) U.S. Cl.

CPC ..... *E05C 17/46* (2013.01); *E05F 5/06* (2013.01); *E05Y 2201/224* (2013.01); *E05Y 2900/132* (2013.01)

(58) Field of Classification Search

CPC ..... E05C 17/46; E05C 17/52; E05C 17/60; E05C 17/64; E05F 5/06; E05Y 2201/224; E05Y 2201/222; E05Y 2900/132; Y10T 16/61; Y10T 16/625; Y10T 16/628

See application file for complete search history.

(56) References Cited

U.S. PATENT DOCUMENTS 2,189,048 A 2/1940 Underhill
2,230,598 A * 2/1941 Mason ..... E05C 17/52 292/70
2,289,873 A * 7/1942 Claud-Mantle ..... E05C 19/066 292/70
2,496,691 A 2/1950 Berry
2,530,365 A * 11/1950 Johnson ..... E05C 17/52 292/17
2,885,237 A * 5/1959 Heyer ..... E05C 19/066 292/70

(Continued)

FOREIGN PATENT DOCUMENTS

JP 11182127 A * 7/1999
JP 2008184897 A * 8/2008

OTHER PUBLICATIONS

Amazon.com, Inc., "Door Stopper, Sheoolor Door Stop with 3M Double-Sided Adhesive Pad, No Drill Rust-Proof Door Holder Doorstop, Better Protection for Wall and Door, Great for Office, Home and School (3-Pack, Brown)," [Retrieved on Oct. 31, 2018. Retrieved from the Internet: https://www.amazon.com/dp/B07GYNWGMM/ref=sspa_dk_detail_7?psc=1&pd_rd_i=B07GYNWGMM&pf_rd_m=ATVPDKIKX0DER&pf_rd_p=f52e26da-1287-4616-824b-efc564ff75a4&pf_rd_r=GKET4JV7Z2WNPWGGY08S&pd_rd_wg=oGUe4&pf_rd_s=desktop-dp-sims&pf_rd_t=40701&pd_rd_w=j2OoB&pf_rd_i=desktop-dp-sims&pd_rd_r=b083acbf-ba8b-11e8-85dd-873fcc9bd247].

(Continued)

*Primary Examiner* — Chuck Y Mah

(74) *Attorney, Agent, or Firm* — Kilpatrick Townsend & Stockton LLP

(57) ABSTRACT

One example of the present disclosure includes a system having a catch configured to attach to a door or a wall. The catch can include a base, an elongated member extending outwardly from the base and defining a chamber therein, and a resilient member having (i) a first end positioned in the chamber and (ii) a second end. The resilient member can define an inner diameter that is larger at the second end of the resilient member than at the first end of the resilient member. The system can also include a door stop configured to couple to the other of the door or the wall. The door stop can include an end member extending therefrom and being receivable within the inner diameter of the resilient member of the base.

18 Claims, 7 Drawing Sheets

(56) References Cited

U.S. PATENT DOCUMENTS

| | | | | | |
|---|---|---|---|---|---|
| 3,055,689 | A * | 9/1962 | Jorgensen | E05C 17/52 | 292/70 |
| 3,100,664 | A | 8/1963 | Duval | | |
| 3,180,666 | A * | 4/1965 | Jorgensen | E05C 17/52 | 292/70 |
| 3,243,836 | A * | 4/1966 | Reiss | E05C 17/52 | 16/85 |
| 3,675,959 | A * | 7/1972 | Hansen | E05C 17/52 | 292/70 |
| 5,517,721 | A * | 5/1996 | Roth | E05C 17/52 | 16/86 A |
| 5,575,514 | A * | 11/1996 | Troy | E05C 17/52 | 292/203 |
| 5,701,635 | A * | 12/1997 | Hawkes | E05B 1/0061 | 16/421 |
| 6,209,170 | B1 * | 4/2001 | Huynh | E05C 17/52 | 16/86 A |
| 6,588,811 | B1 | 7/2003 | Ferguson | | |
| 6,629,335 | B1 * | 10/2003 | Derman | E05C 17/52 | 16/82 |
| 2005/0204507 | A1 * | 9/2005 | Huang | E05F 5/06 | 16/86 R |
| 2006/0021191 | A1 * | 2/2006 | Huang | E05F 5/06 | 16/82 |

OTHER PUBLICATIONS

Amazon.com, Inc., "HaloVa Magnetic Door Stop Stainless Steel Door Stopper, Door Holder Doorstop, 3M Double-Sided Adhesive Tape No Need to Drill," [Retrieved on Oct. 31, 2018. Retrieved from the Internet: https://www.amazon.com/HaloVa-Magnetic-Stainless-Doorstop-Double-Sided/dp/B06XS6NSJX/ref=pd_lpo_vtph_bs_img_1?_encoding=UTF8&psc=1&refRID=GKET4JV7Z2WNPWGGY08S].

Amazon.com, Inc., "HomeNice Magnetic Door Stop Silicone Door Stopper, Door Holder Doorstop, Special viscous Adhesive Tape No Need to Drill Collision mute prevent from rusting," [Retrieved on Oct. 31, 2018. Retrieved from the Internet: https://www.amazon.com/HomeNice-Magnetic-Silicone-Doorstop-Collision/dp/B01BXP6O8C].

Amazon.com, Inc., "HUAYY 304 Stainless Steel Soft-Catch Magnetic Door Stop Protection Wall Mount Hydraulic Buffer Sound Dampening Bright Silver Door Stopper HYY-18012502," [Retrieved on Oct. 31, 2018. Retrieved from the Internet: https://www.amazon.com/dp/B0798W878V/ref=sspa_dk_detail_8?psc=1&pd_rd_i=B0798W878V].

Amazon.com, Inc., "Revolutionary Magnetic Door Stop,Lifemaster Silicone Door Stopper, Self-Adhesive Attaches with NO Screws or Nails. Reusable, Washable. Better Protection for Walls, Doors. Great for Office & Home.," [Retrieved on Oct. 31, 2018. Retrieved from the Internet: https://www.amazon.com/dp/B076VBXTV4/ref=sspa_dk_detail_4?psc=1&pd_rd_i=B076VBXTV4&pf_rd_m=ATVPDKIKX0DER&pf_rd_p=f52e26da-1287-4616-824b-efc564ff75a4&pf_rd_r=GKET4JV7Z2WNPWGGY08S&pd_rd_wg=oGUe4&pf_rd_s=desktop-dp-sims&pf_rd_t=40701&pd_rd_w=j2OoB&pf_rd_i=desktop-dp-sims&pd_rd_r=b083acbf-ba8b-11e8-85dd-873fcc9bd247].

Amazon.com, Inc., "SANSUM Magnetic Door Stop Stainless Steel Door Stopper Bumper, 3M Double-Sided Adhesive Tape Doorstop Door Suction Holder No Need to Drill/Drill 2 in 1," [Retrieved on Oct. 31, 2018. Retrieved from the Internet: https://www.amazon.com/dp/B07CXR6B5J/ref=sspa_dk_detail_4?psc=1&pd_rd_i=B07CXR6B5J].

etrailer.com, "Plunger and Rubber Socket Door Holder—1¾" Long Plunger," [Retrieved on Oct. 31, 2018. Retrieved from the Internet: https://www.etrailer.com/Enclosed-Trailer-Parts/Polar-Hardware/PLR62-66.html?feed=npn&gclid=Cj0KCQjwof3cBRD9ARIsAP8x70McKRyhdrsNyiJwCrD001zZGVKQPdWwZtyxkDsQIhR-TTEk5cjdvUEaAjNDEALw_wcB].

* cited by examiner

SILENT DOOR STOP AND CATCH

TECHNICAL FIELD

The present disclosure relates generally to door stops. More specifically, but not by way of limitation, this disclosure relates to a silent door stop and catch.

BACKGROUND

Conventional door stops include metal rods connected to the base of a door. These rods extend outwardly from the door so as to collide with the baseboard of an adjacent wall, which prevents the door handle from impacting and damaging the wall. But these collisions are loud and particularly disturbing in quiet settings. And these collisions can cause the door to rebound (e.g., bounce back) away from the wall, which can lead to injury or repeated collisions between the door stop and baseboard.

Some door stop manufacturers have attempted to solve the rebounding problem by providing door stops with corresponding catch mechanisms, or "catches," that attach to the wall's baseboard. Existing catches include magnets that attract and couple with the door stop in order to maintain the door in an open position. But these door stop-and-catch combinations are often even louder, since the attractive magnetic forces between the door stop and the catch results in increased momentum with which these components collide. And these magnets are often rare-earth magnets that are difficult and expensive to obtain.

SUMMARY

One example of the present disclosure includes a system having a catch and a door stop. The catch is configured to attach to a door or a wall. The catch includes a base, an elongated member extending outwardly from the base and defining a chamber therein, and a resilient member. The resilient member has (i) a first end positioned in the chamber and (ii) a second end. The resilient member defines an inner diameter that is larger at the second end of the resilient member than at the first end of the resilient member. The door stop is configured to couple to the other of the door or the wall. The door stop has an end member extending therefrom and being receivable within the inner diameter of the resilient member of the base for stopping an opening of the door.

The above catch and door stop can have various additional or alternative features. In some examples, the second end of the resilient member is positioned externally to the chamber of the elongated member. In some examples, the inner diameter of the resilient member has an inner surface that slopes between the first end and the second end at an angle of between one degree and three degrees. In some examples, the resilient member is positioned within the chamber such that the resilient member is coaxial with the chamber about a central axis extending through the resilient member and the chamber. In some examples, the resilient member is configured to rotate relative to the elongated member about the central axis. In some examples, the second end of the resilient member tapers outwardly from the inner diameter to an edge of the resilient member at an angle of between 15 degrees and 30 degrees.

Another example of the present disclosure includes a catch for a door stop. The catch includes a base, an elongated member extending outwardly from the base and defining a chamber therein, and a resilient member. The resilient member has (i) a first end positioned in the chamber and (ii) a second end. The resilient member defines an inner diameter that is larger at the second end of the resilient member than at the first end of the resilient member. The inner diameter is configured to receive the door stop. The door stop is couplable to a door or a wall for stopping an opening of the door.

The above catch can have various additional or alternative features. In some examples, the second end of the resilient member is positioned externally to the chamber of the elongated member. In some examples, the inner diameter of the resilient member has an inner surface that slopes between the first end and the first end at an angle of between one degree and three degrees. In some examples, the resilient member is positioned within the chamber such that the resilient member is coaxial with the chamber about a central axis extending through the resilient member and the chamber. In some examples, the resilient member is configured to rotate relative to the elongated member about the central axis. In some examples, the second end of the resilient member tapers outwardly from the inner diameter to an edge of the resilient member at an angle of between 15 degrees and 30 degrees. In some examples, the chamber has grooves and the resilient member has ridges configured to cooperate with the grooves to affix the resilient member within the chamber.

Yet another example of the present disclosure includes a method. The method includes receiving, by a catch attached to a door or a wall, a door stop within an inner diameter of a resilient member of the catch. The door stop is attached to the other of the door or the wall. The method also includes coupling, via a frictional coupling, the door stop with the inner diameter of the resilient member to maintain the door in an open position. The inner diameter of the resilient member is larger at a second end of the resilient member than at a first end of the resilient member for establishing the frictional coupling.

The door stop and catch in the above method can have various additional or alternative features. In some examples, the door stop includes an elongated member extending outwardly from a base and defining a chamber therein. In some examples, the first end of the resilient member is positioned within the chamber. In some examples, the second end is positioned externally to a chamber defined through an elongated member of a base. In some examples, the inner diameter of the resilient member has an inner surface that slopes between the first end and the second end at an angle of between one degree and three degrees. In some examples, the resilient member is positioned within an elongated member of a base such that the resilient member is coaxial with the elongated member about a central axis extending through both the resilient member and the elongated member. In some examples, the resilient member is configured to rotate relative to the elongated member about the central axis. In some examples, the second end of the resilient member tapers outwardly from the inner diameter to an edge of the resilient member at an angle of between 15 degrees and 30 degrees.

This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

DETAILED DESCRIPTION

Certain aspects and features of the present disclosure relate to a door stop and corresponding catch for enabling a user to quietly open a door and maintain the door in an open position. The door stop can be attached to the door or the wall. The catch can be attached to the other of the door or the wall. The catch can include a base and an elongated member extending outwardly from the base. The elongated member can define a chamber into which a resilient member can be at least partially positioned. The resilient member can have an inner diameter into which the door stop can be received when a user opens the door. The resilient member is formed from a resilient material (e.g., an elastomer such as rubber, silicone, neoprene, fluorosilicone, butyl, or any combination of these) for absorbing force and reducing sound resulting from the door stop impacting the catch, thereby enabling the user to quietly open the door. And the inner diameter of the resilient member can be sized to frictionally couple with the door stop in order to maintain the door in the open position.

In some examples, the resilient member has an inner diameter that is larger at one end than at the other end. This can enable the catch to remain capable of maintaining the door in the open position, if the resilient material wears down over time from repeated use, by simply pushing the door stop deeper into the inner diameter of the resilient member.

In some examples, the resilient member can rotate relative to the base about a central axis extending through the resilient member. This "play" can improve the ability of the catch to absorb force and dissipate sound.

In some examples, the resilient member has an end that tapers outwardly from the inner diameter to an edge. For example, the end may taper outwardly at an angle of between 15 degrees and 30 degrees. This tapering can enable the door stop to enter the inner diameter of the resilient member at a variety of angles, such that the door stop does not need to be situated perfectly perpendicular to the catch. This can significantly simplify setup of the door stop-and-catch system.

These illustrative examples are given to introduce the reader to the general subject matter discussed here and are not intended to limit the scope of the disclosed concepts. The following sections describe various additional features and examples with reference to the drawings in which like numerals indicate like elements but, like the illustrative examples, should not be used to limit the present disclosure.

Figure 1:
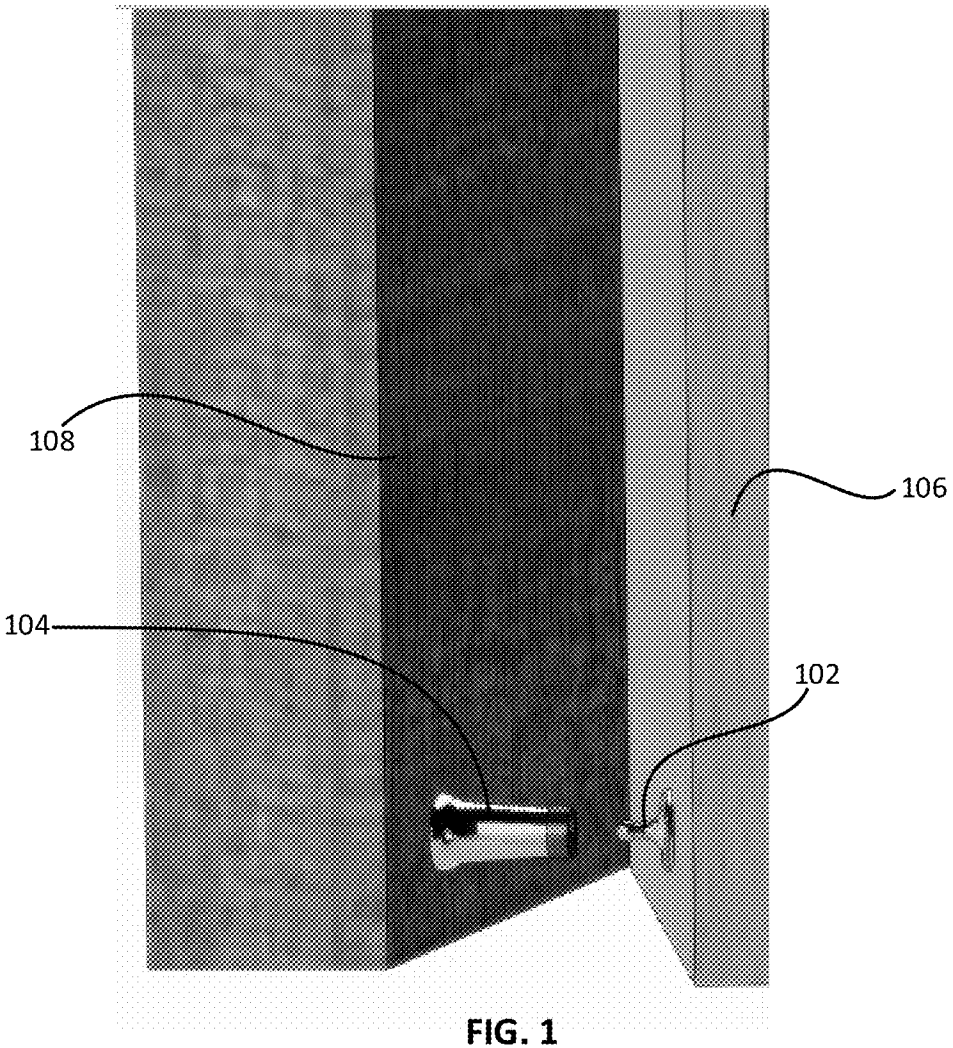
FIG. 1 is a perspective view of a door stop attached to a door and catch attached to a wall according to some aspects.

FIG. 1 is a perspective view of a door stop 102 and catch 104 according to some aspects. In this example, the door stop 102 is attached to the door 106 and the catch 104 is attached to the wall 108. But in other examples, the door stop 102 can be attached to the wall 108 and the catch 104 can be attached to the door 106. Either way, as a user opens the door 106, the door stop 102 will enter into the catch 104, at which point the door stop 102 frictionally couples (i.e., couple via friction) with the catch 104 and thereby maintains the door in an open position. To close the door 106, the user need only apply sufficient force to the door 106 to overcome the frictional coupling between the door stop 102 and the catch 104.

Figure 2:
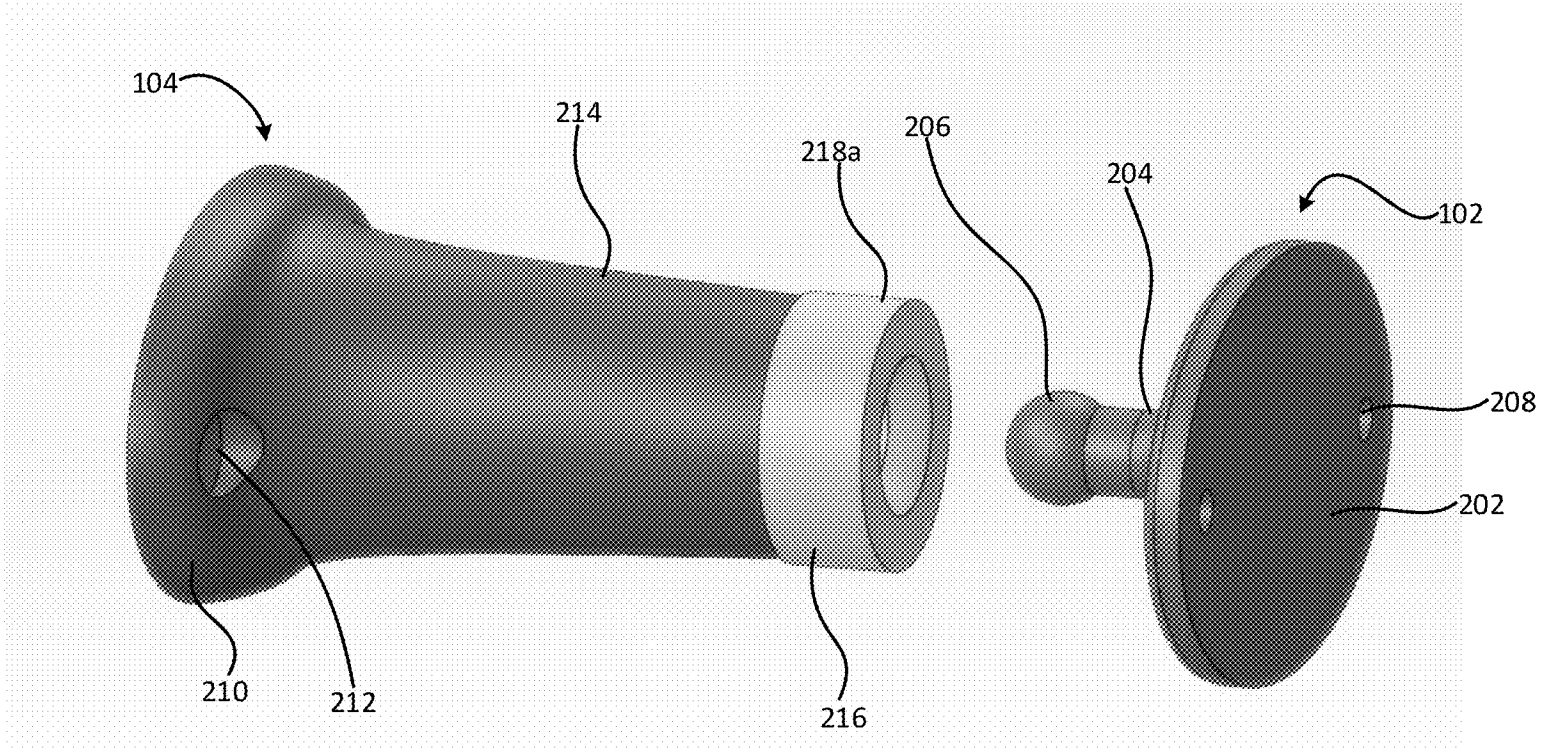
FIG. 2 is a perspective view of a door stop and catch according to some aspects.

One example of the door stop 102 and catch 104 is shown in FIG. 2. In this example, the door stop 102 includes a base 202 having mounting holes 208 for attaching the base 202 to a door or wall via fasteners (e.g., nails or screws). A stem 204 extends outwardly from the base 202 of the door stop 102. The stem 204 has a generally cylindrical shape in FIG. 2, but other shapes are possible. In this example, a distal end of the stem 204 includes an end member 206 that is partially rounded in shape, but other examples can involve the end member having another shape (e.g., square or rectangular shapes). The end member 206 is sized to enter, and be retained within, an inner diameter of a resilient member 216 of the catch 104. The partially-rounded shape of the end member 206 can enable it to enter the inner diameter of the resilient member 216 at a variety of angles, such that the door stop 102 need not be installed perfectly perpendicular to the catch 104 in order to properly operate.

The catch 104 also includes a base 210 having mounting holes 212 for attaching the base 210 to the other of the door or wall. An elongated member 214 extends outwardly from the base 210 and defines a chamber therein. In this example, the elongated member 214 has a generally cylindrical shape, but other shapes are possible. At least one end (not visible in FIG. 2) of the resilient member 216 is disposed within the chamber. Another end 218*a* of the resilient member can be positioned externally to the chamber, for example, to absorb force from impacts between the door stop 102 and the catch 104.

Figure 3:
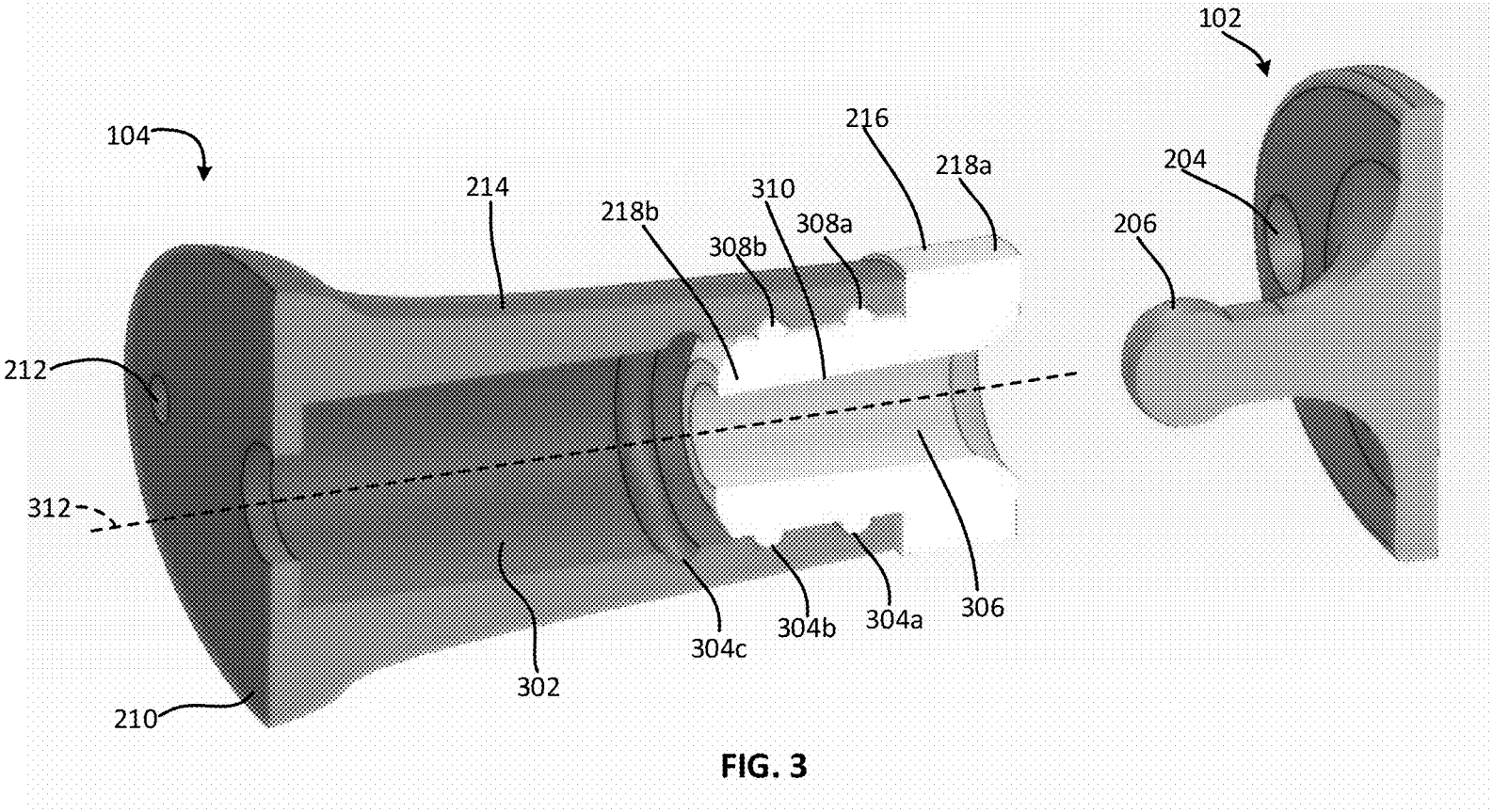
FIG. 3 is a cross-sectional side view of a door stop and catch according to some aspects.
Figure 4:
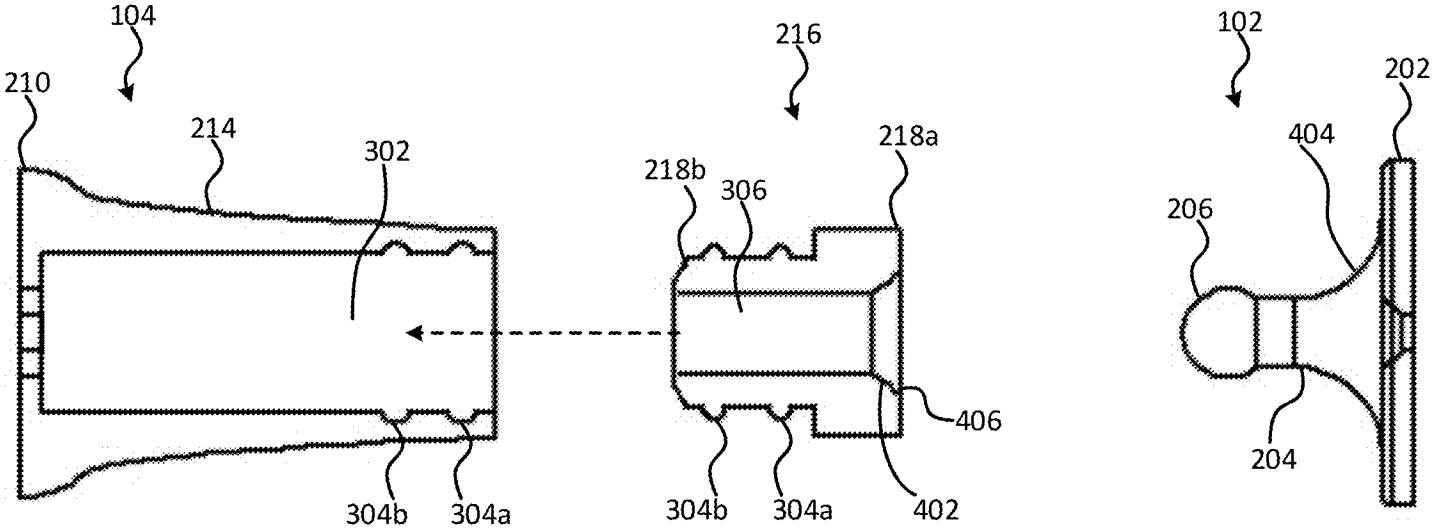
FIG. 4 is an exploded, cross-sectional side view of a door stop and catch according to some aspects.

FIGS. 3-4 are cross-sectional side views of the door stop 102 and catch 104 according to some aspects of the present disclosure. As shown in FIG. 3, the catch 104 can include a chamber 302 defined by the elongated member 214. The chamber 302 can have a larger diameter than at least a portion of the outer diameter of the resilient member 216. This can enable at least a portion of the resilient member 216 to fit within the chamber 302, such that both the resilient member 216 and the chamber 302 are positioned coaxially around a central axis 312 extending through the resilient member 216 and the chamber 302.

To maintain the resilient member 216 within the chamber 302, the resilient member 216 can include ribs 308*a-b* on its outer surface. The ribs 308*a-b* can be sized and positioned to fit within corresponding grooves 304*a-c* in the inner surface of the chamber 302. The resilient member 216 can include any number and combination of ribs 308*a-b* corresponding to any number and combination of grooves in the inner surface of the chamber 302. The ribs 308*a-b* and grooves 304*a-c* can enable the resilient member 216 to rotate relative to the base 210 (and the elongated member 214) about the central axis 312. This can improve the ability of the catch 104 to absorb force and dissipate sound.

As discussed above, the resilient member 216 has an inner diameter 306 for receiving the end member 206 of the door stop 102. In some examples, the inner diameter 306 can decrease in size between one end 218*a* of the resilient member 216 and the other end 218*b* of the resilient member 216. For example, an inner surface 310 within the interior of the resilient member 216 can slope at a 1-3 degree angle between the ends 218*a-b*. This slope can enable the catch 104 to continue to hold a door open, should the resilient member 216 wear over time. But other examples may have an inner diameter 306 that is uniform, such that the inner surface 310 has no slope.

Referring now to FIG. 4, the end 218*a* of the resilient member 216 can have a tapered surface 402 that tapers outwardly from the inner diameter 306 to an edge 406 of the resilient member 216. For example, the end 218*a* can taper outwardly at an angle of between 15 and 30 degrees. This tapering can enable the end member 206 of the door stop 102 to enter the inner diameter 306 of the resilient member 216 at a variety of angles, so that the door stop 102 does not need to be situated perfectly perpendicular to the catch 104. This can significantly simplify setup of the system.

In some examples, the tapered surface 402 can correspond to a skirt 404 of the door stop's stem 204. For example, both the tapered surface 402 and the skirt 404 can have the same angle, so that when the stem 204 is inserted all the way into the inner diameter 306 of the resilient member 216, the tapered surface 402 can serve as a seat against which the skirt 404 lays flush (e.g., as shown at interface 602 of FIG. 6).

The outer diameter of the resilient member 216 can change in size along a length of the resilient member 216. For example, as shown in FIG. 4, roughly two thirds of the length of the resilient member 216 is sized to fit within the chamber 302 of the elongated member 214, while the remaining one third is sized to be larger than the chamber 302. This remaining one third can serve as a pad against which the door stop 102 can collide for absorbing these forces. But any other suitable configuration is possible. For instance, in another example, the outer diameter of the resilient member 216 can be uniformly sized, such that the entire resilient member 216 is capable of fitting within the chamber 302.

While the resilient member 216 of FIG. 4 has a generally cylindrical shape, other shapes are also possible, so long as at least one end 218*b* fits within the chamber 302 of the elongated member 214. For instance, in other examples, the chamber 302 and the resilient member 216 can both have an oval, square, or rectangular cross-sectional end shape.

Figure 5:
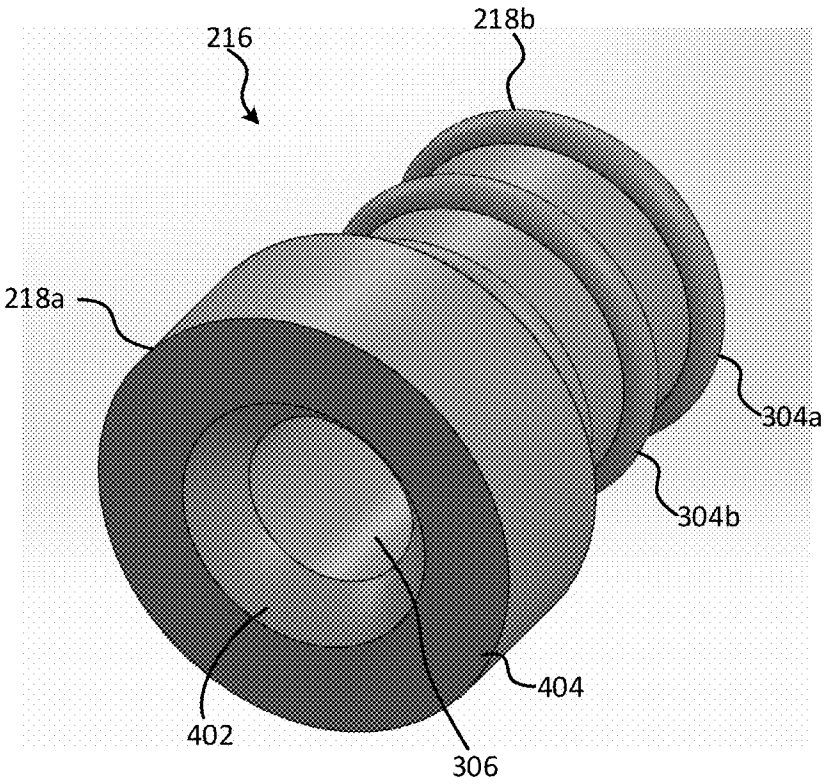
FIG. 5 is a perspective view of a resilient member according to some aspects.

FIG. 5 depicts another example of the resilient member 216, in which the tapered surface 402 is more clearly visible. As shown, the tapered surface 402 can extend from the inner diameter 306 of the resilient member 216 to an edge 406. The tapered surface 402 can taper at any suitable angle.

Figure 6:
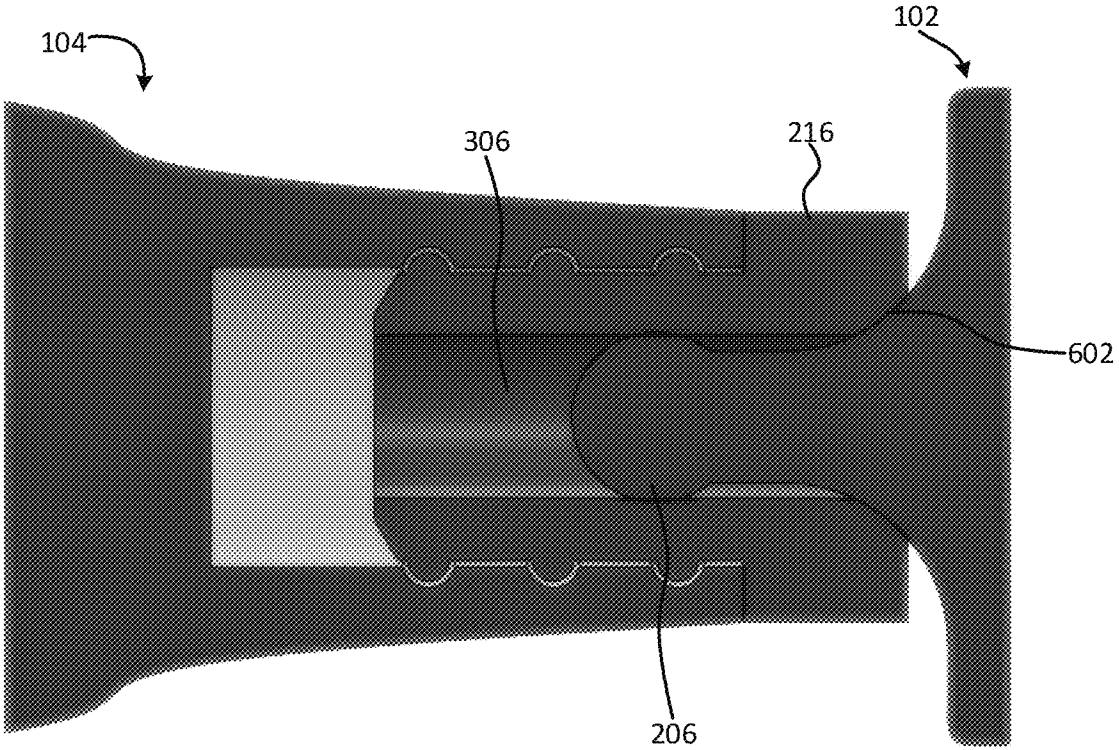
FIG. 6 is a cross-sectional side view of a door stop inserted into a catch according to some aspects.
Figure 7:
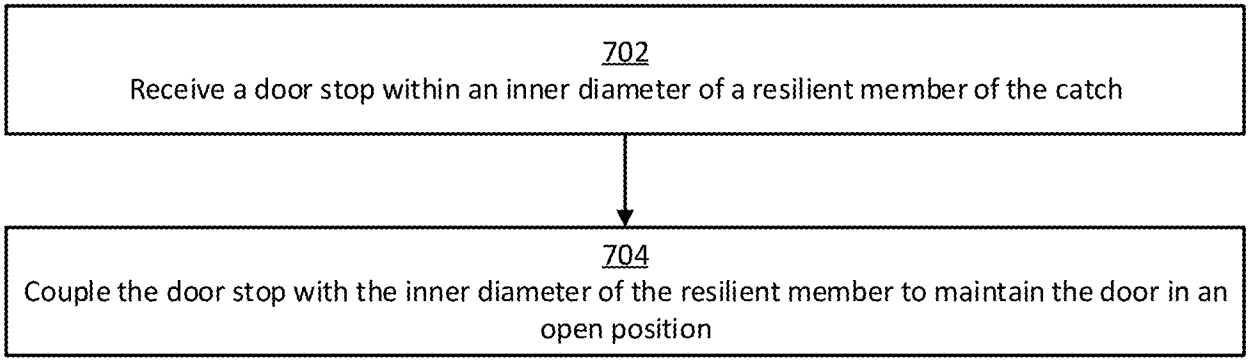
FIG. 7 is a flow chart of an example of a process implemented by a catch according to some aspects.

FIG. 6 is a cross-sectional view of an example in which the door stop 102 is positioned inside the catch 104 to maintain a door in an open position. More specifically, as the door is opened, the end member 206 of the door stop 102 enters the inner diameter 306 of the resilient member 216 and frictionally engages with the inner surface of the resilient member 216, thereby forming a frictional coupling between the catch 104 and the door stop 102. The frictional coupling can maintain the door in an open position. As the door stop 102 is pushed deeper into the inner diameter 306 of the resilient member 216, the frictional coupling can increase, making it harder to release the door. When the door stop 102 is fully inserted, the tapered surface of the resilient member 216 can sit flush against the skirt of the door stop 102 at an interface 602 between the two.

At a future point in time, a user may wish to release the door. To release the door 106, the user need only apply sufficient force to the door to pull the end member 206 from the inner diameter 306 of the catch 104.

One example of a process implemented by a catch 104 of the present disclosure is shown in FIG. 6. The steps below are described with reference to the components of FIGS. 1-5 discussed above.

In block 702, the catch 104 receives a door stop 102 within an inner diameter 306 of a resilient member 218 of the catch 104. The catch 104 can be attached to a door or a wall, and the door stop 102 can be attached to the other of the door or the wall.

In block 704, the catch 104 couples the door stop 102 with the inner diameter 306 of the resilient member 218 to maintain the door in an open position. The catch 104 can couple the door stop 102 with the inner diameter 306 of the resilient member 218 via a frictional coupling. In some examples, the inner diameter 306 of the resilient member 218 is larger at a second end 218*a* of the resilient member 218 than at a first end 218*b* of the resilient member for helping to establish the frictional coupling.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure. For instance, any example(s) described herein can be combined with any other example(s).

The invention claimed is:

1. A system comprising:

a catch configured to attach to a door or a wall, the catch comprising:

a base;

an elongated member extending outwardly from the base and defining a chamber therein; and a resilient member having (i) a first end positioned in the chamber and (ii) a second end, the resilient member defining an inner diameter that is larger at the second end of the resilient member than at the first end of the resilient member, wherein the inner diameter of the resilient member has an inner surface that slopes between the first end and the second end at an angle of between one degree and three degrees; and a door stop configured to couple to the other of the door or the wall, the door stop having an end member extending therefrom and being receivable within the inner diameter of the resilient member of the base for stopping an opening of the door.

2. The system of claim 1, wherein the second end is positioned externally to the chamber of the elongated member, and wherein the end member is partially rounded in shape.

3. The system of claim 1, wherein the resilient member is positioned within the chamber such that the resilient member is coaxial with the chamber about a central axis extending through the resilient member and the chamber.

4. The system of claim 3, wherein the resilient member is configured to rotate relative to the elongated member about the central axis.

5. The system of claim 1, wherein the second end of the resilient member tapers outwardly from the inner diameter to an edge of the resilient member at an angle of between 15 degrees and 30 degrees.

6. A method comprising:

receiving, by a catch attached to a door or a wall, a door stop within an inner diameter of a resilient member of the catch, wherein the door stop is attached to the other of the door or the wall; and modifying, by the catch, a frictional coupling between the door stop and the inner diameter of the resilient member in proportion to an amount in which the door stop is inserted into the catch to maintain the door in an open position, wherein the inner diameter of the resilient member is larger at a second end of the resilient member than at a first end of the resilient member for establishing the frictional coupling.

7. The method of claim 6, wherein the door stop comprises an elongated member extending outwardly from a base and defining a chamber therein, and wherein the first end of the resilient member is positioned within the chamber.

8. The method of claim 6, wherein the second end is positioned externally to a chamber defined through an elongated member of a base.

9. The method of claim 6, wherein the inner diameter of the resilient member has an inner surface that slopes between the first end and the second end at an angle of between one degree and three degrees.

10. The method of claim 6, wherein the resilient member is positioned within an elongated member of a base such that the resilient member is coaxial with the elongated member about a central axis extending through both the resilient member and the elongated member.

11. The method of claim 10, wherein the resilient member is configured to rotate relative to the elongated member about the central axis.

12. The method of claim 6, wherein the second end of the resilient member tapers outwardly from the inner diameter to an edge of the resilient member at an angle of between 15 degrees and 30 degrees.

13. A catch for a door stop, the catch comprising:

a base;

an elongated member extending outwardly from the base and defining a chamber therein; and a resilient member configured to rotate relative to the elongated member about a central axis, the resilient member having (i) a first end positioned within the chamber and (ii) a second end, the resilient member defining an inner diameter that is larger at the second end of the resilient member than at the first end of the resilient member, wherein the inner diameter is configured to receive the door stop, the door stop being couplable to a door or a wall for stopping an opening of the door.

14. The catch of claim 13, wherein the second end is positioned externally to the chamber of the elongated member.

15. The catch of claim 13, wherein the inner diameter of the resilient member has an inner surface that slopes between the first end and the first end at an angle of between one degree and three degrees.

16. The catch of claim 13, wherein the resilient member is positioned within the chamber such that the resilient member is coaxial with the chamber about a central axis extending through the resilient member and the chamber.

17. The catch of claim 13, wherein the second end of the resilient member tapers outwardly from the inner diameter to an edge of the resilient member at an angle of between 15 degrees and 30 degrees.

18. The catch of claim 13, wherein the chamber has grooves and the resilient member has ridges configured to cooperate with the grooves to affix the resilient member within the chamber.

* * * * *